US005458413A

United States Patent [19]

Huber et al.

[11] Patent Number: 5,458,413

[45] Date of Patent: Oct. 17, 1995

[54] DRAWER

[75] Inventors: Edgar Huber, Hard; Erich Röck, Höchst, both of Austria

[73] Assignee: Julius Blum Gesellschaft m.b.H., Höchst, Austria

[21] Appl. No.: 372,314

[22] Filed: Jan. 13, 1995

[30] Foreign Application Priority Data

Jan. 17, 1994 [AT] Austria ..... 73/94

[51] Int. Cl.[6] ..... A47B 88/04

[52] U.S. Cl. ..... 312/348.4; 312/348.1; 312/348.2; 312/334.27; 312/334.32; 312/330.1

[58] Field of Search ..... 312/348.1, 348.2, 312/348.4, 330.1, 334.27, 334.32

[56] References Cited

U.S. PATENT DOCUMENTS 4,162,114 7/1979 Litchfield et al. ..... 312/348.1 X
5,265,953 11/1993 Röck et al. .

FOREIGN PATENT DOCUMENTS 0425447 5/1991 European Pat. Off. .
2206034 12/1988 United Kingdom ..... 312/348.1

*Primary Examiner*—Kenneth J. Dorner
*Assistant Examiner*—Rodney B. White
*Attorney, Agent, or Firm*—Wenderoth, Lind & Ponack

[57] ABSTRACT

A drawer comprising two double-walled drawer sides (1) made of metal, a drawer base (14), two pull-out rails (2), as well as two securing devices (4) for a front wall (5) which, in the mounted state, is located between the two drawer sides (1). The front wall (5) has at both ends (4) (sic) a fitting (8) provided with a stop plate (9) which is located next to the front wall (5) and which covers the front side of the drawer side (1). The front wall (5) has in cross section an upper closed profile (10) and a lower rearwardly open profile (11) with a front covering web (12). The lower open profile (11) receives the front edge of the drawer base (14). The front wall (5) has a rear web (15) which is directed perpendicularly to the drawer base (14) and terminates at the drawer base (14).

6 Claims, 4 Drawing Sheets

DRAWER

BACKGROUND OF THE INVENTION

The invention relates to a drawer comprising two double-walled drawer sides made of metal or plastics material, a drawer base, two pull-out rails, as well as two securing devices for a front wall which, in the mounted state, is located between the two drawer sides, the front wall having at both ends in each case one fitting provided with a stop plate which is located next to the front wall and which covers the front side of the drawer side, and each fitting having a hook by means of which it can be anchored in the securing device by hanging into the latter.

With regard to the position of the front panels or front walls in relation to the drawer sides, essentially two different types can be distinguished. In the first type, the front panels extend, widthwise, at least over the entire drawer width and in the mounted state lie against the front sides of the drawer sides. For rapid mounting of the front panels, in this type of drawer a few quick connectors to the drawer sides are known. Here, the front panels, provided with premounted fittings, are advantageously fitted or hung from the front onto the drawer sides of the drawer which is otherwise already finished, and then pulled by a connecting device, for example a clamping eccentric, toward the front sides of the drawer sides, the rear side of the front panels serving as a stop lying against the front sides.

In the second type of drawer, the front walls lie, in the mounted state, between the drawer sides. Drawers of this kind are generally employed as so-called internal drawers, in the case of which a box door or the like arranged in front of the front wall conceals in the closed state one or more front walls of drawers. To connect such front walls lying between the drawer sides to the drawer sides, it is known to provide specially designed drawer sides with inwardly protruding securing angles onto which the front wall can then be screwed from inside. The assembly of such a drawer is relatively time-consuming. Moreover, there is the risk that the loose fastening screws required for assembly might get lost. Another disadvantage is to be found in the fact that special side constructions with securing angles are used which are suitable solely for these front walls lying between the sides.

From EP-A1-0 291 781 a securing device is known which makes it possible to secure a front wall, for example made of a particleboard, quickly to the drawer sides.

EP-A1-0 425 447 shows a drawer with four identical walls which can be interconnected by plug-in couplings. The coupling elements are arranged here in the four corners of the drawer. With a coupling of this kind, the front cover cannot be mounted set back between the two side walls, nor is it possible for the front cover to cover the front faces of the drawer sides.

SUMMARY OF THE INVENTION

For the furniture manufacturer, the choice between a front cover lying frontally against the drawer sides and a front wall located between the drawer sides means the necessity also to provide different bases, since in the case of a conventional front wall the termination at the drawer base lies farther back than in the case of a front cover. It is therefore not possible to prefabricate and preassemble the drawer, except for the front cover or front wall.

The object of the invention is to improve a drawer to the effect that it can be assembled in respect of the drawer rear wall, the drawer sides and the drawer base irrespective of whether the front termination is effected by a front cover or a front wall.

The object according to the invention is achieved in that the front wall has in cross section an upper closed profile and a lower rearwardly open profile with a front covering web, which lower rearwardly open profile receives the front edge of the drawer base which terminates at the front ends of the drawer sides, the front wall having a rear terminating web which is directed perpendicularly to the drawer base and terminates at the drawer base.

DETAILED DESCRIPTION OF A PREFERRED EMBODIMENT

Figures 1, 3:
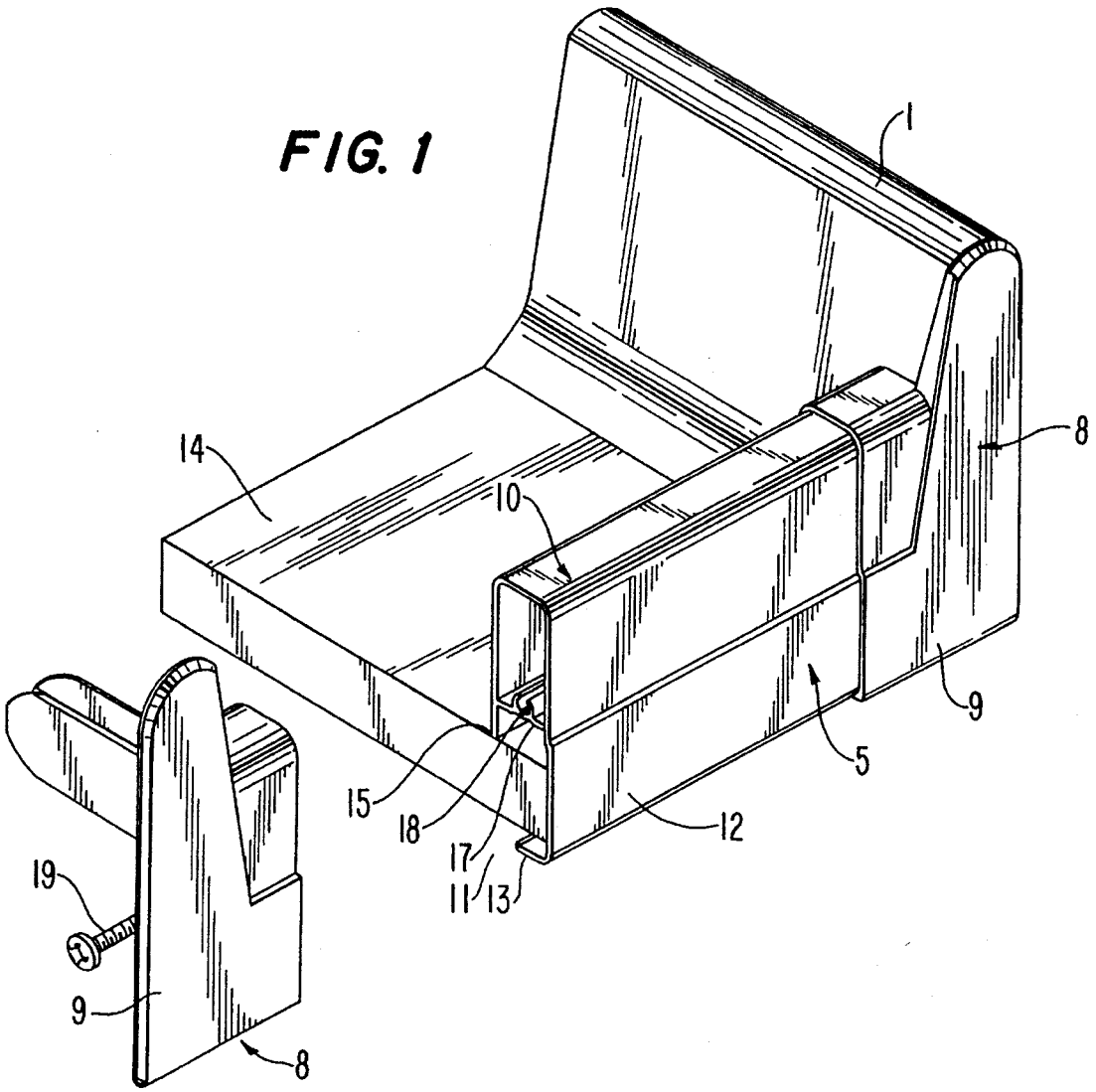
FIG. 1 shows a diagram of the front corner of a drawer with a front wall.
FIG. 3 shows a diagram of the fitting seen from the front and from the side of the drawer.
Figure 2:
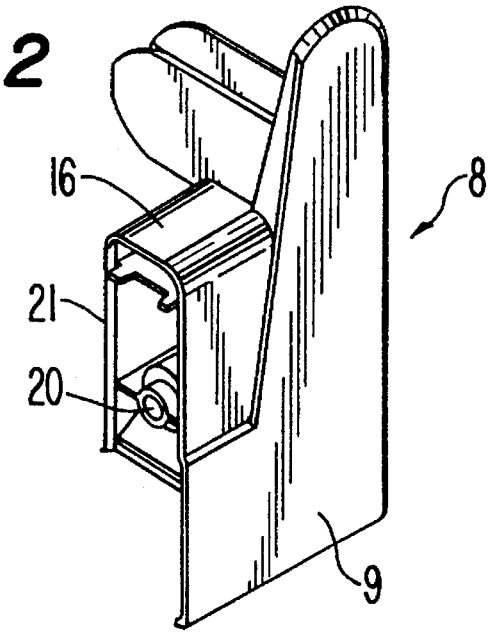
FIG. 2 shows a diagram of the fitting seen from the front and middle of the drawer.
Figure 4:
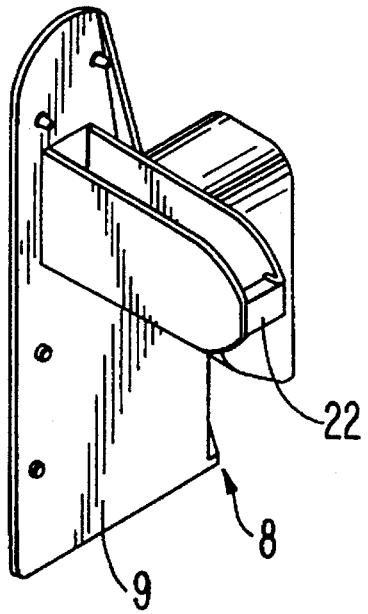
FIG. 4 shows a diagram of the fitting seen from the rear.
Figure 5:
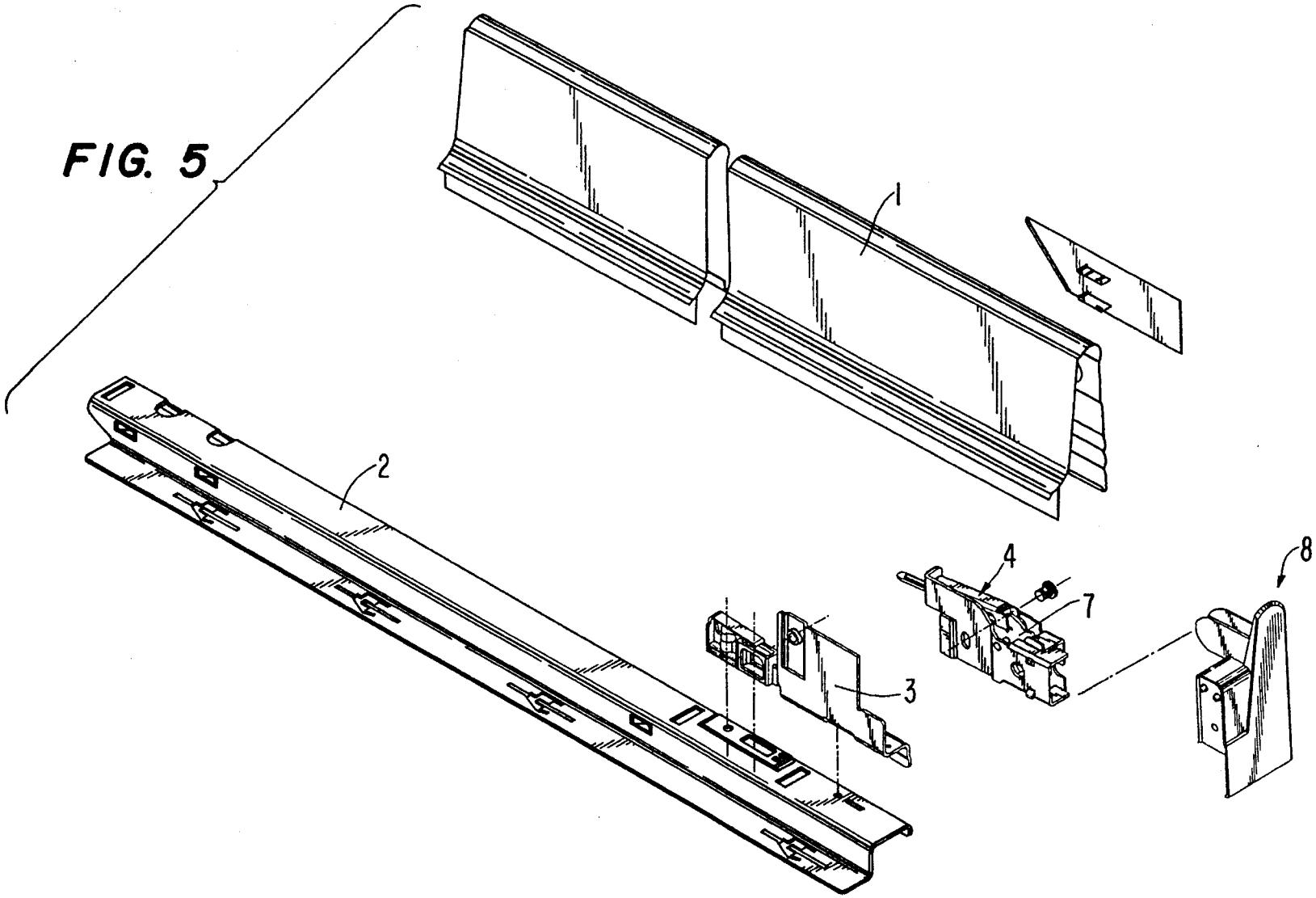
FIG. 5 shows an exploded view of the drawer side, the pull-out rail, the securing device and the fitting
Figure 6:
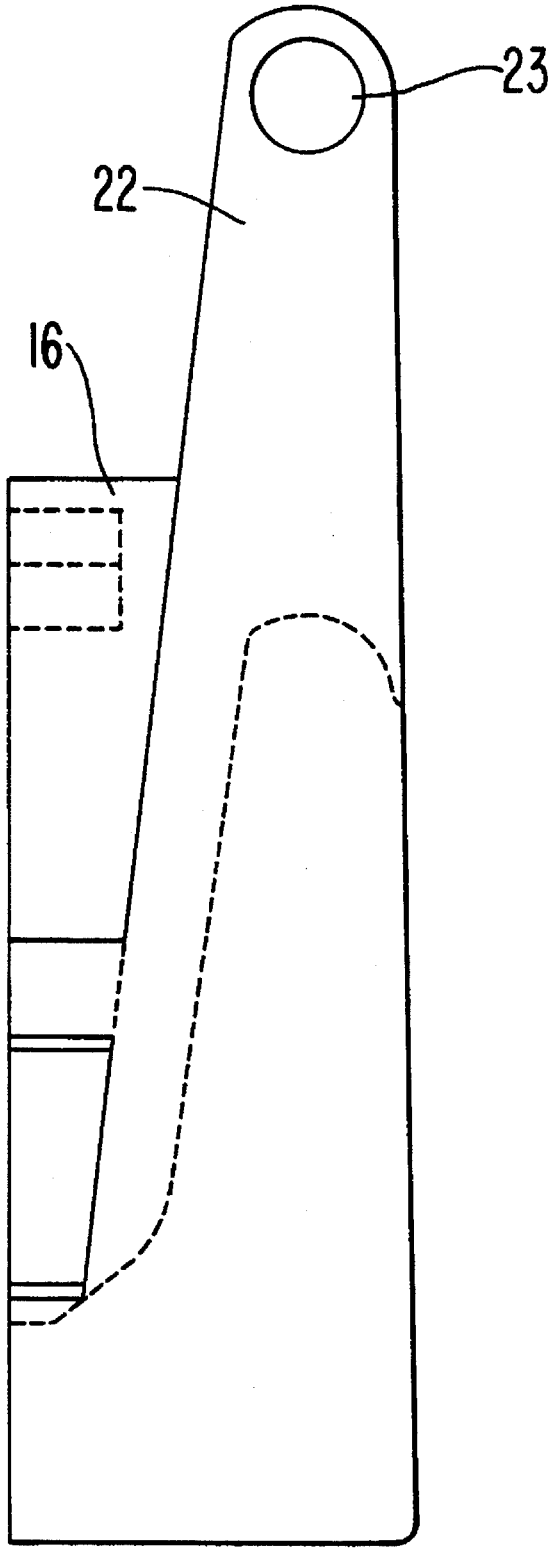
FIG. 6 shows a front view of a fitting according to a further exemplary embodiment of the invention.

The drawer according to the invention has a double-walled drawer side 1 which may be made of plastics material, but also of aluminum or Nirosta.

The drawer side 1 is secured to a pull-out rail 2 of a pull-out guide assembly. The pull-out rail 2 also bears a holding plate 3 which is welded or riveted to said rail. Screwed to the holding plate 3 is securing device 4 for a front cover or the front wall 5.

The securing device 4 has a spring-loaded tilting segment 7 which, in the mounted condition, engages on a hook 22 of the fitting 8 and thus holds the fitting 8 against the drawer side 1.

The fitting 8 has a front stop plate 9 which covers the drawer side 1 at the front sides.

The front wall 5 has at the top a cross-sectionally closed profile 10 and at the bottom a cross-sectionally open profile 11 with a front covering web 12. Adjoining the front covering web 12 at the bottom is a horizontal web 13 which covers the front edge of the drawer base 14. In the exemplary embodiment, the horizontal web 13 is located at a distance from the drawer base 14. Since the distance between the lower edge of the terminating web 15 and the horizontal web 13 is kept relatively large, drawer bases 14 of different thickness can be combined with the front wall 5.

The drawer base 14 projects into the open profile 11 and abuts frontally against the covering web 12. As a result, the drawer base 14 can be the same length as in the case of a conventional front cover.

At the rear, the front wall 5 has a terminating web 15 which terminates at the drawer base 14.

The fittings 8 are provided with a lateral housing 16 into which one end of the front wall 5 can be inserted.

The front wall 5 has a central horizontal web 17 which bears two holding cheeks 18.

A screw 19 projecting through a passage channel 20 of the fitting can be screwed in between the holding cheeks 18.

For the mounting of the front wall 5, the latter is inserted by its ends into the holding edge 21 of the housing 16 and then fixed by the screws 19.

The front wall 5 may, just like the drawer sides, be made of plastics material, aluminum or Nirosta steel.

We claim:

1. A drawer comprising two double-walled drawer sides (1) made of metal or plastics material, a drawer base (14), two pull-out rails (2), as well as two securing devices (4) for a front wall (5) which, in the mounted state, is located between the two drawer sides (1), the front wall (5) having at both ends in each case one fitting (8) provided with a stop plate (9) which is located next to the front wall (5) and which covers the front side of the drawer side (1), and each fitting (8) having a hook (22) by means of which it can be anchored in the securing device (4) by hanging into the latter, wherein the front wall (5) has in cross section an upper closed profile (10) and a lower rearwardly open profile (11) with a front covering web (12), which lower rearwardly open profile (11) receives the front edge of the drawer base (14) which terminates at the front ends of the drawer sides (1), the front wall (5) having a rear web (15) which is directed perpendicularly to the drawer base (14) and terminates at the drawer base (14).

2. The drawer as claimed in claim 1, wherein the stop plate (9) of the fitting (8) terminates, at the bottom, at the front covering web (12) of the front wall (5).

3. The drawer as claimed in claim 1, wherein the front wall(5 ) has a horizontal central web (17) with holding cheeks (18) between which there is held a screw (19) projecting through a passage channel (20) in the fitting (8).

4. The drawer as claimed in claim 1, wherein the fitting (8) has laterally a housing (16) into which the end of the front wall (5) can be inserted.

5. The drawer as claimed claim 1 wherein the fitting (8) has a support (22) projecting above the drawer sides and provided with a holding device for a railing (23).

6. The drawer as claimed in claim 1, wherein the front covering web (12) of the front wall (5) is adjoined by a rearwardly directed horizontal web (13) located underneath the drawer base (14) and at a distance therefrom.

* * * * *